US007802703B2

(12) United States Patent
Kiser

(10) Patent No.: US 7,802,703 B2
(45) **Date of Patent: *Sep. 28, 2010**

(54) COLLAPSIBLE CONTAINER SYSTEM

(76) Inventor: Earl T. Kiser, 28 Georgetown, Fort Myers, FL (US) 33919

( * ) Notice: Subject to any disclaimer, the term of this patent is extended or adjusted under 35 U.S.C. 154(b) by 3 days.

This patent is subject to a terminal disclaimer.

(21) Appl. No.: 12/151,307

(22) Filed: May 6, 2008

(65) Prior Publication Data

US 2008/0245825 A1 Oct. 9, 2008

(51) Int. Cl.
*B65D 5/72* (2006.01)

(52) U.S. Cl. ..... 222/500; 222/95; 222/105; 222/147; 222/153.07; 222/183; 222/479; 222/568; 215/17; 215/21

(58) Field of Classification Search ..... 222/500, 222/105, 94–95, 107, 183, 477, 479, 481.5, 222/482, 547, 567–568, 153.07, 541.9, 147, 222/153.05, 153.06, 386.5; 215/28, 312, 215/15–18, 21
See application file for complete search history.

(56) References Cited

U.S. PATENT DOCUMENTS

| | | | | |
|---|---|---|---|---|
| 906,381 | A | 12/1908 | Carmer et al. | |
| 2,113,048 | A | 4/1938 | Gross | |
| 2,321,836 | A | 6/1943 | Marzo | |
| 2,554,570 | A | 5/1951 | Harvey | |
| 2,698,703 | A | 1/1955 | Harvey | |
| 2,828,054 | A | 3/1958 | Chiaramonte | |
| 2,991,897 | A | 7/1961 | Burnett | |
| 3,809,290 | A * | 5/1974 | Schmit | 222/88 |
| 4,330,066 | A | 5/1982 | Berliner | |
| 4,723,688 | A * | 2/1988 | Munoz | 222/88 |
| 4,984,713 | A * | 1/1991 | Chambers et al. | 222/386.5 |
| 5,249,714 | A | 10/1993 | Merhar | |
| 5,433,346 | A | 7/1995 | Howe | |
| 5,641,098 | A | 6/1997 | Roedhus et al. | |
| 5,911,345 | A | 6/1999 | Castleberry | |
| 6,220,311 | B1 | 4/2001 | Litto | |
| 6,585,134 | B2 * | 7/2003 | Farris | 222/95 |
| 6,708,850 | B2 | 3/2004 | Uetake | |
| 7,140,514 | B2 | 11/2006 | Kiser | |
| 2005/0029285 | A1 | 2/2005 | Gay, III | |

FOREIGN PATENT DOCUMENTS

| | | |
|---|---|---|
| WO | WO 8501491 A1 * | 4/1985 |
| WO | WO 8600868 A1 * | 2/1986 |
| WO | WO8903353 | 4/1989 |

* cited by examiner

*Primary Examiner*—Frederick C. Nicolas
(74) *Attorney, Agent, or Firm*—Timothy S. Stevens

(57) ABSTRACT

A three part container system. The first part is an outer rigid container formed with a mouth defining an opening into the outer container. The second part is an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid. The third part is a turret fitted directly or indirectly by way of the outer container to the mouth of the inner container. The turret contains a one way valve so that if the inner container contains a liquid and the collapsible portion of the inner container is held above the turret, the fluid in the inner container will flow through the one way valve and out of the mouth of the turret as the inner container collapses within the outer container.

13 Claims, 6 Drawing Sheets

COLLAPSIBLE CONTAINER SYSTEM

BACKGROUND OF THE INVENTION

This application claims the benefit of priority to U.S. patent application Ser. No. 12/070,059 filed Feb. 14, 2008 which claimed the benefit of priority to U.S. patent application Ser. No. 11/585,640 filed Oct. 24, 2006 which claimed the benefit of priority to U.S. patent application Ser. No. 11/257,870 filed Oct. 25, 2005.

The instant invention is in the field of collapsible containers for containing liquids to be dispensed through valves. More specifically, the instant invention is in the field of hand held collapsible containers for containing liquids to be dispensed by inverting the container for gravity flow of the liquid through a one way valve so that air does not enter the collapsible container when the container is righted to stop the flow of the liquid.

Many liquids, such as alcoholic beverages, fruit juices and dairy products rapidly deteriorate upon exposure to oxygen following the initial opening of the container. An important solution to this problem is a collapsible container for containing such liquids to be dispensed through a valve at a controlled volume. Collapsible containers made from animal skins, organs, bota bags, and date back to ancient time.

Many liquids are susceptible to deterioration upon exposure to oxygen. Among these, wines are particularly vulnerable to rapid oxidation due their basic chemistry. To prevent this condition, bottling practices are followed by most commercial wineries that fill the container under vacuum or by sparging with an inert gas to exclude the oxygen. This precaution is further complicated by the use of closures, i.e. natural cork, susceptible to oxygen intrusion or other containments such as trichloroanisole (TCA). Even with these precautions, when the container is subsequently opened, oxygen intrusion immediately occurs and begins the process of oxidation and spoilage and the remaining product rapidly degrades/spoils.

The introduction of "bag in a box wine" (wherein the wine is contained in a collapsible plastic bag held in a cardboard box and dispensed through a valve at the bottom of the container, closed with a plastic cap) addressed both problems (oxygen intrusion and closure) but is limited in its practical use since the wine cannot be poured, but must be dispensed from the container in an upright position. U.S. Pat. No. 4,330,066 disclosed a bottle having collapsible inner container and a one way valve so that a liquid contained in the collapsible inner container is dispensed when the bottle is inverted and so that flow of air back into the collapsible inner container is prevented by closure of the one way valve when the bottle is righted. The one way valve of the '066 patent must never-theless accommodate the initial filling of the bottle which seriously limits this approach.

SUMMARY OF THE INVENTION

The above-mentioned problem of filling the collapsible inner container through the one way valve is solved in the instant invention by the use of a "turret". The preferred turret of the instant invention contains a one way valve, a controlled volume of flow dispensing passageway, a directional pouring lip, a pilfer proof closure and a skirt (capsule) that marries the turret to the container with a sanitary junction. Thereby, a collapsible inner container can be initially filled and then the turret is attached to the bottle. The system of the instant invention allows the reasonable processing/production use of more effective and less complicated one way valves and permits the practical use of conventional filling machines. The system of the instant invention is especially applicable for containing and dispensing wine and all liquids susceptible to oxygen degradation.

More specifically, the instant invention is a container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position.

DETAILED DESCRIPTION

Figure 1:
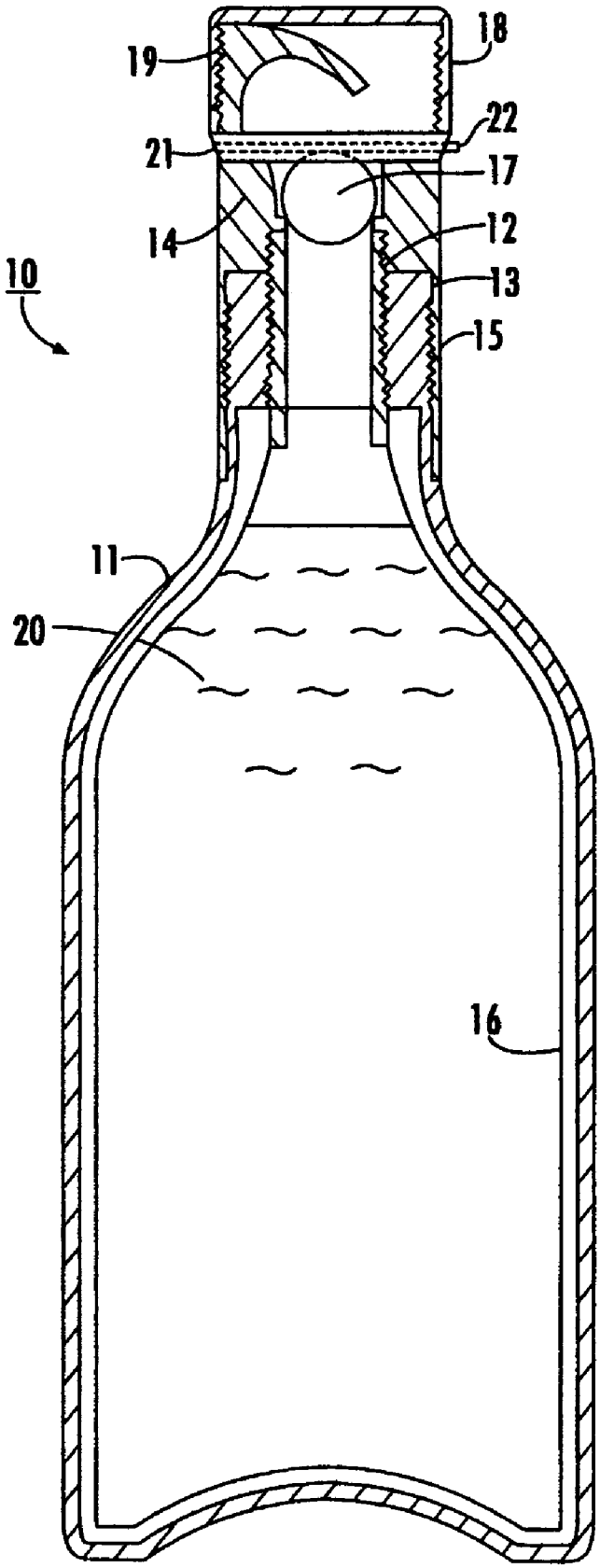
FIG. 1 is a side view, part in cross-section and part in full, of a preferred container system of the instant invention employing threaded components.

Referring now to FIG. 1, therein is shown a side view, part in cross-section and part in full, of a preferred container system 10 of the instant invention including an outer container 11 made of conventional polyethylene terephthalate (PET) plastic. However, it should be understood that the outer container 11 can be made of any suitable material such as glass, other plastics or even metal. The outer container 11 is of substantially fixed shape formed with a mouth 13 defining an opening into the outer container 11. The system 10 also includes an inner container 16 positioned within the outer container 11, the inner container 16 formed with a mouth 12 defining an opening into the inner container 16, the mouth 12 of the inner container being positioned in and sealed to or adjacent to the mouth 13 of the outer container 11 by way of a threaded connection as shown. At least a portion of the inner container 16 is collapsible so that the inner container can be filled with a liquid 20 such as wine. When the liquid 20 needs to be protected from atmospheric oxygen, then the inner container 16 is preferably an oxygen barrier film made of Nylon brand plastic, Saran brand plastic, polyethylene vinyl alcohol plastic or multilayer films comprising an oxygen barrier plastic. The inner container 16 can alternatively be made of metalized plastic film such as metalized Mylar brand plastic. Preferably, the inner container 16 is heat sealed to the mouth 12. Alternatively, the mouth 12 of the inner container 16 can be heat sealed to the mouth 13 of the outer container 11. When the liquid 20 needs to be protected from atmospheric oxygen, then the oxygen permeability of the film of the inner container 16 is preferably less than 1.3 mL of oxygen per square meter of film per day under standard temperature and pressure conditions. Plastic/laminar bags (pouches/cells) are commercially available from manufactures such as Thermo Fisher Scientific and Tetra Pac, both of Vernon Hills, Ill. Scholle Corp., Northlake, Ill. and others.

A significant benefit of the instant invention, when the material 20 is considered to require controlled amounts of oxygen to permit proper maturation, is the ability to correlate the desired degree of oxygen transfer thru the inner container 16, to achieve maximum effectiveness under specific controlled conditions. In addition to the use of oxygen transfer to support proper ageing of certain wines, numerous tests have identified varying and optimum oxygen transfer rates for particular varietals of wines and extending into styles of wine. Utilization of the ability to provide an inner container 16 with a low, medium or high Oxygen Transfer Rate (OTR) will permit, with the combination of pre-bottling analysis, the potential achievement of optimum total maturities, including, but not limited to, the amelioration of bitter and astringent characteristics, tanning's and acids, as well as the enhancement of aromas, flavors, tastes, color and overall chemical structure. In this respect, the instant invention provides a major advancement in oenological practice, not before obtainable thru the use of either screw cap or natural cork closures, as the former admits no oxygen and the OTR of the later is not reproducible on any reasonable consistent basis. Furthermore, the OTR of the inner container 16 can be readily adjusted by changing, for example and without limitation thereto, the thickness of and/or the number and type of layers of materials used and by deposition of fillers such as nano particles in the formation of the inner container 16, in a specifically controlled and measurable manner.

Still referring to FIG. 1, a turret 14 is fitted to the mouth 12 of the inner container 16 and to the mouth 13 of the outer container 11 by way of threaded connections as shown. The turret 14 is preferably made of injection molded food grade oxygen impermeable plastic. The turret 14 contains a ball 17 which acts as a one way valve in liquid communication with the mouth 12 of the inner container by way of a passageway in the turret 14 as shown. The ball 17 is preferably made of a compliant material, such as an elastomer, so that it can be pressed through this passageway from the bottom of the turret 14. The turret 14 defines a mouth 19 in liquid communication with the ball 17 by way of a passageway in the turret 14 as shown. The exterior of the mouth 19 of the turret 14 is threaded for a cap 18. A pilfer-proof seal 21 is positioned on the skirt of the cap 18. A pull-tab 22 is provided to remove the seal 21 so that the cap 18 can be removed. The passageways in the turret are preferably dimensioned to control the volume (or more specifically the flow rate) of liquid flowing therethrough.

Figure 2:
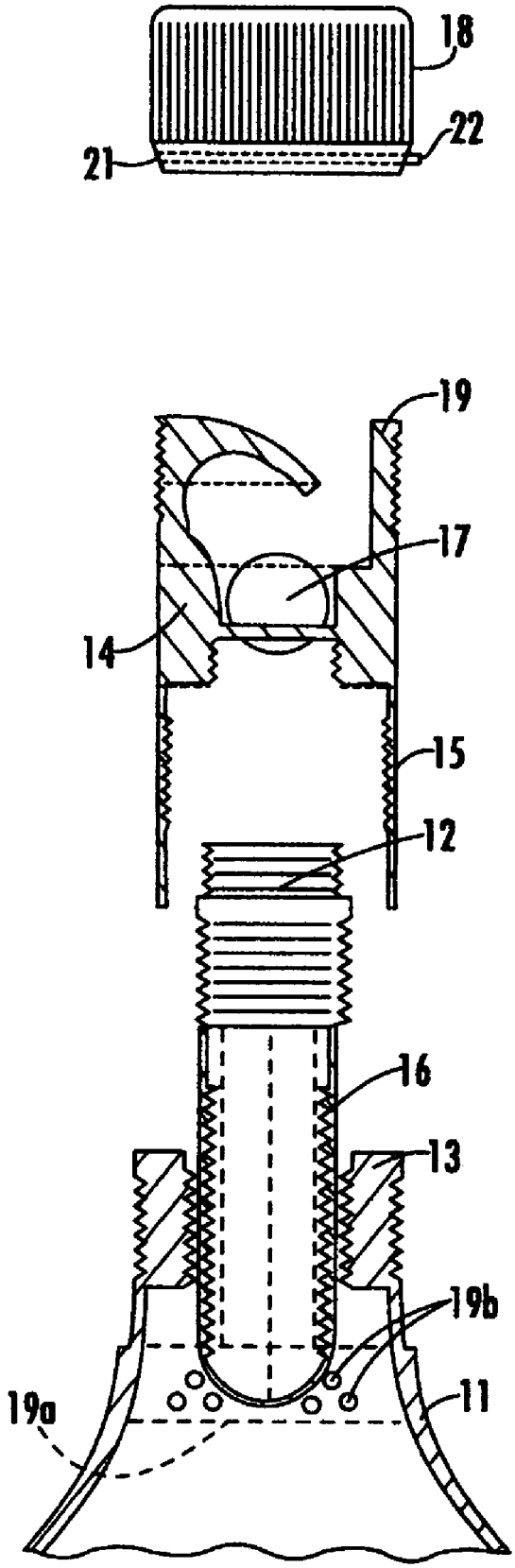
FIG. 2 is a side exploded view, part in cross section and part in full, of the system shown in FIG. 1.

Referring now to FIG. 2, therein is shown exploded view, part in cross section and part in full, of the system shown in FIG. 1. The collapsible inner container 16 is shown in a collapsed state for insertion into the outer container 11. An inner supporting cage, not shown, may be necessary to support the collapsed inner container 16 when the container system 10 is filled by vacuum filling. The outer container 11 is preferably formed with a decorative band 19*a* containing air vents 19*b*. The turret 14 is preferably joined to outer container 11 by a sanitary seal where the bottom of the turret 14 contacts the top of the decorative band 19*a*.

Figure 3:
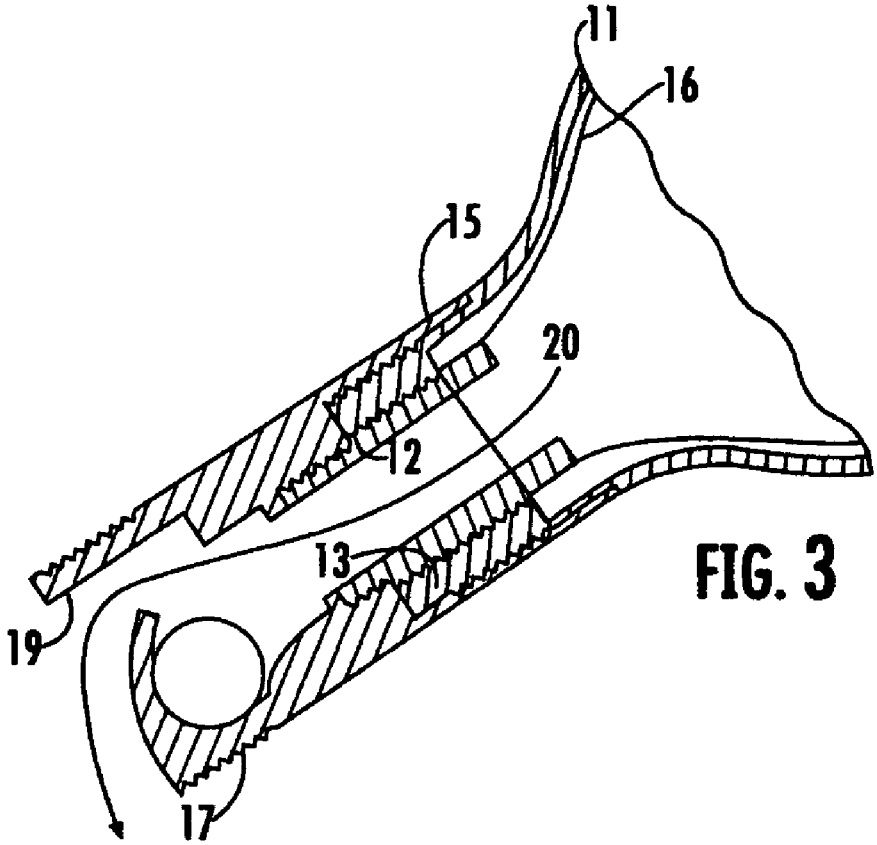
FIG. 3 is a side view of the system shown in FIG. 1 in position to dispense a liquid contained in the collapsible inner container.

Referring now to FIG. 3, therein is shown a side view of the system shown in FIG. 1 with the collapsible portion of the inner container 16 held above the turret 14 so that the liquid 20 in the inner container will flow through the turret 14 as the inner container 16 collapses within the outer container 11. The outer container 11 is preferably perforated to facilitate entry of air between the outer container 11 and the inner container 16 as the inner container 16 collapses. When the container system is righted so that the turret 14 is held above the inner container 16, flow of air back into the inner container 16 is substantially prevented by the movement of the ball 17 back to its seated position as shown in FIG. 1. Thereby, the liquid 20 can be protected from atmospheric oxygen deterioration.

Figure 4:
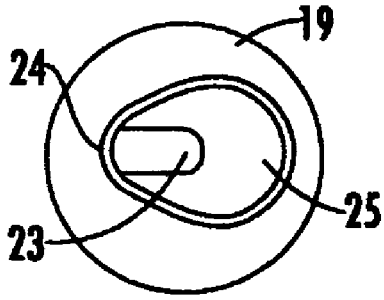
FIG. 4 is a top view in full of a preferred turret of the instant invention.

Referring now to FIG. 4, therein is shown a top view in full of a preferred turret of the instant invention having a mouth 19 and a directional pour lip 24. A tear-away closure 25 is provided with a pull tab 23 for removal of the tear-away closure 25 upon the initial opening of the container system.

Figure 5:
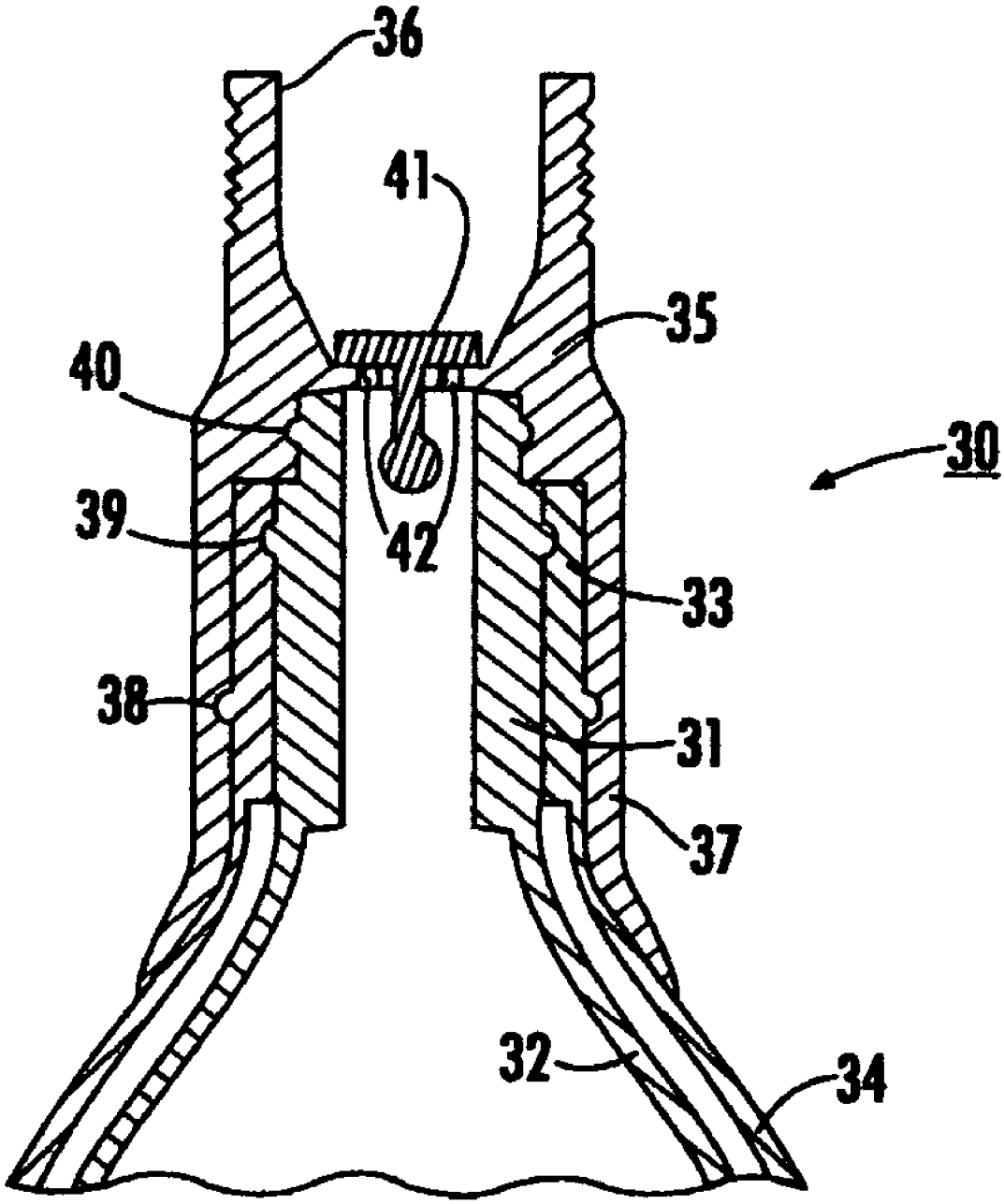
FIG. 5 is a side view in cross-section of a preferred container system of the instant invention employing press fit components.

Referring now to FIG. 5, therein is shown a side cross-sectional view of a preferred container system 30 of the instant invention similar to the container system 10 of FIG. 1 but employing press fit connections of many of the various components. The container system 30 includes an outer container 34 made of conventional polyethylene terephthalate (PET) plastic. However, it should be understood that the outer container 34 can be made of any suitable material such as glass, other plastics or even metal. The outer container 34 is of substantially fixed shape formed with a mouth 33 defining an opening into the outer container 34. The system 30 also includes an inner container 32 positioned within the outer container 34, the inner container 32 is formed with a mouth 31 defining an opening into the inner container 32, the mouth 31 of the inner container being positioned in and sealed to the mouth 33 of the outer container 34 by way of a press fit and annular band 39 formed on the mouth 31 of the inner container 32 and a corresponding groove formed in the mouth 33 of the outer container 34. At least a portion of the inner container 32 is collapsible so that the inner container 32 can be filled with a liquid such as wine. When the liquid needs to be protected from atmospheric oxygen, then the inner container 32 is preferably an oxygen barrier film made of Nylon brand plastic, Saran brand plastic, polyethylene vinyl alcohol plastic or multilayer films comprising an oxygen barrier plastic. The inner container 32 can also be made of metalized plastic film such as metalized Mylar brand plastic. Plastic films in the form of bags suitable for exposure to wine are commercially available from Tetra Pac, Inc. of Vernon Hills, Ill. as well as from Scholle Corp, Container Division, Northlake, Ill. Preferably, the inner container 32 is heat sealed to the mouth 31.

Still referring to FIG. 5, a turret 35 is fitted to the mouth 31 of the inner container 32 and to the mouth 33 of the outer container 34 by way of a press fit and annular bands 38 and 40 formed on the mouth 31 of the inner container 32 and on the mouth 33 of the outer container 32 and corresponding grooves formed in the turret 35 as shown. The turret 35 is preferably made of injection molded food grade plastic. The turret 35 contains a retained disk 41 which acts as a one way valve in liquid communication with the mouth 31 of the inner container 32 by way of passageways 42 in the turret 35 as shown. The turret 35 defines a mouth 36 in liquid communication with the retained disk 41 and passageways 42 by way of a passageway in the turret 35 as shown. The exterior of the mouth 36 of the turret 35 is threaded to receive a cap. When the collapsible portion of the inner container 32 held above the turret 35, the liquid in the inner container will flow through the turret 35 as the inner container 32 collapses within the outer container 34. The outer container 34 is preferably perforated to facilitate entry of air between the outer container 34 and the inner container 32 as the inner container 32 collapses. When the container system 30 is righted so that the turret 35 is held above the inner container 32, flow of air back into the inner container 32 is substantially prevented by the movement of the retained disk 41 back to its seated position as shown in FIG. 4. Thereby, the liquid in the inner container 32 can be protected from atmospheric oxygen deterioration.

The ball based one way valve of the container system of FIG. 1 and the retained disk based one way valve of the container system of FIG. 4 are specific examples, without limitation thereto, of one way valves (also known as check valves) that can be used in the instant invention.

Figure 6:
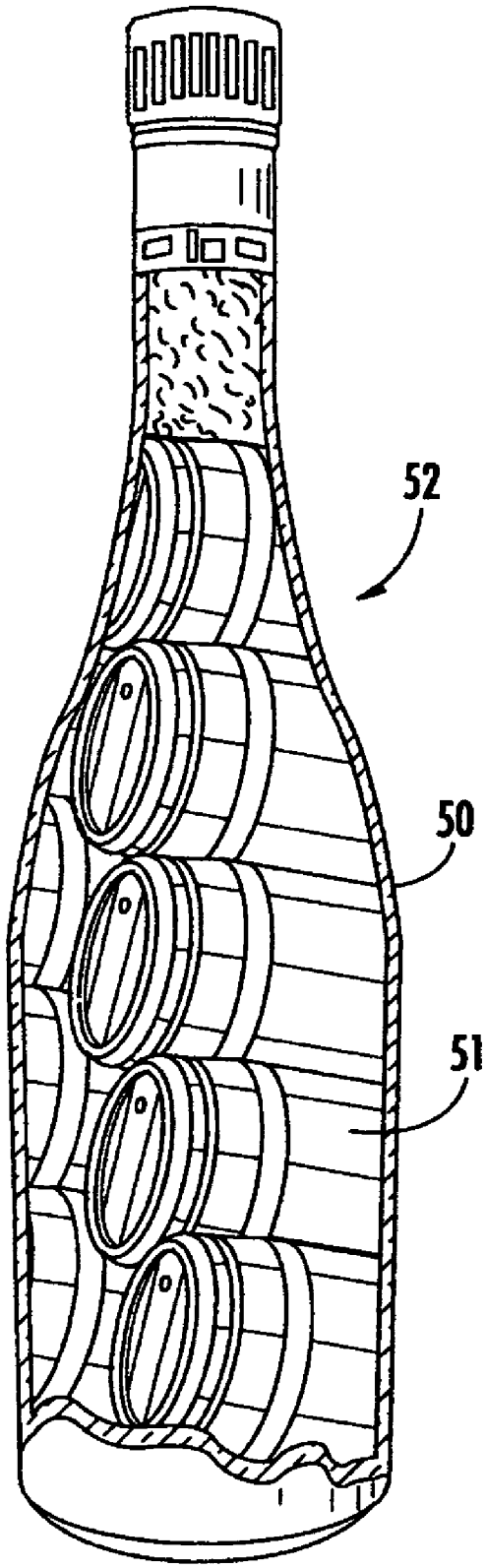
FIG. 6 is a side view, partially broken away, of a preferred container system of the instant invention employing a collapsible inner container having imprinted thereon a design in the form of an assembly of wine barrels.
Figure 7:
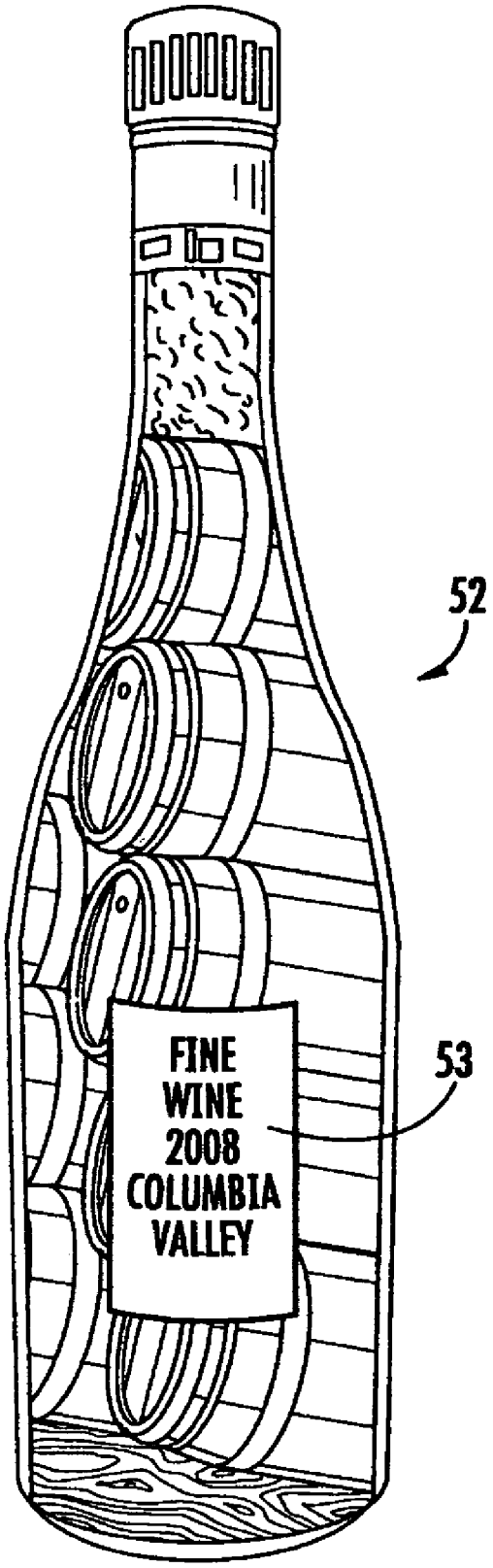
FIG. 7 is a side view of the container system of FIG. 6 having a transparent outer container and a label attached thereto.

Referring now to FIG. 6, therein is shown a side view, partially broken away, of a preferred container system 52 of the instant invention employing a collapsible inner container 51 having imprinted thereon a design in the form of an assembly of wine barrels and a transparent outer container 50. The collapsible inner container 51 preferably comprises an elastomer so that the collapsible inner container 51 collapses not unlike a deflating balloon in the outer container 50. Referring now to FIG. 7, therein is shown a side view of the container system 52 of FIG. 6 having a label 53 attached thereto.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains and which fall within the limits of the following claims.

What is claimed is:

1. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the mouth of the inner container is of fixed shape having external threads and wherein the mouth of the outer container has internal threads dimensioned to engage the external threads of the mouth of the inner container.

2. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the mouth of the outer container has external threads, wherein the turret has a skirt and wherein the skirt of the turret has internal threads dimensioned to engage the external threads of the outer container.

3. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position wherein the mouth of the inner container is of fixed shape having external threads and wherein the mouth of the outer container has internal threads dimensioned to engage the external threads of the mouth of the inner container, wherein the mouth of the outer container has external threads, wherein the turret has a skirt and wherein the skirt of the turret has internal threads dimensioned to engage the external threads of the outer container.

4. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the mouth of the inner container is of fixed shape and dimensioned to be a press fit in the mouth of the outer container, wherein the mouth of the outer container has external threads, wherein the turret has a skirt and wherein the skirt of the turret has internal threads dimensioned to engage the external threads of the outer container.

5. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position wherein the mouth of the inner container is of fixed shape having external threads and wherein the mouth of the outer container has internal threads dimensioned to engage the external threads of the mouth of the inner container, wherein the mouth of the inner container has external threads, wherein the turret has an internal passageway and wherein the internal passageway of the turret has internal threads dimensioned to engage the external threads of the mouth of the inner container.

6. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the mouth of the inner container is of fixed shape and dimensioned to be a press fit in the mouth of the outer container, wherein the mouth of the inner container has external threads, wherein the turret has an internal passageway and wherein the internal passageway of the turret has internal threads dimensioned to engage the external threads of the mouth of the inner container.

7. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position wherein the mouth of the inner container is of fixed shape having external threads and wherein the mouth of the outer container has internal threads dimensioned to engage the external threads of the mouth of the inner container, wherein the turret has a skirt, the inside of the skirt of the turret being dimensioned to be a press fit over the mouth of the outer container.

8. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position wherein the mouth of the inner container is of fixed shape having external threads and wherein the mouth of the outer container has internal threads dimensioned to engage the external threads of the mouth of the inner container, wherein the turret has an internal passageway dimensioned to be a press fit over the mouth of the inner container.

9. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the exterior of the mouth of the turret is threaded to receive an internally threaded cap.

10. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position wherein the mouth of the inner container is of fixed shape having external threads and wherein the mouth of the outer container has internal threads dimensioned to engage the external threads of the mouth of the inner container, wherein the exterior of the mouth of the turret is threaded to receive an internally threaded cap.

11. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the mouth of the inner container is of fixed shape and dimensioned to be a press fit in the mouth of the outer container, wherein the exterior of the mouth of the turret is threaded to receive an internally threaded cap.

12. A container system, comprising: an outer container of substantially fixed shape formed with a mouth defining an opening into the outer container, the outer container also being perforated therethrough with a perforation that does not comprise a valve; an inner container positioned within the outer container, the inner container formed with a mouth defining an opening into the inner container, the mouth of the inner container being positioned in and sealed to or adjacent to the mouth of the outer container, at least a portion of the inner container being collapsible so that the inner container can be filled with a liquid, the inner container being spaced apart from the outer container at the location of the perforation; a turret fitted directly or indirectly by way of the outer container to the mouth of the inner container, the turret comprising a one way valve in liquid communication with the mouth of the inner container by way of a passageway in the turret, the one way valve comprising a freely movable sealing element, the turret defining a mouth in liquid communication with the one way valve by way of a passageway in the turret so that if the inner container contains the liquid and the collapsible portion of the inner container is held above the turret, air can flow through the perforation in the outer container into the space between the outer container and the inner container and the liquid in the inner container will flow through the one way valve by the movement of the sealing element of the one way valve into a non-sealed position, the liquid then flowing out of the mouth of the turret as the inner container collapses within the outer container, and so that if the turret is held above the inner container, flow of air back into the inner container is substantially prevented by the closure of the one way valve by the movement of the sealing element of the one way valve into a sealed position, wherein the turret has a skirt and wherein the bottom of the skirt of the turret and the portion of the outer container mating with the bottom of the skirt of the turret are dimensioned to produce a smooth junction therebetween.

13. The container system of claim 12, wherein the outer container is formed with a decorative band incorporating the perforation through the outer container, the decorative band being positioned immediately below the bottom of the skirt of the turret.

* * * * *